US005819672A

United States Patent [19]

Radway et al.

[11] Patent Number: 5,819,672

[45] Date of Patent: Oct. 13, 1998

[54] TREATMENT TO ENHANCE HEAT RETENTION IN COAL AND BIOMASS BURNING FURNACES

[75] Inventors: Jerrold E. Radway, Lakeside, Calif.; Robert P. Bennett, Houston, Tex.

[73] Assignee: Addchem Systems, Houston, Tex.

[21] Appl. No.: 418,074

[22] Filed: Apr. 6, 1995

[51] Int. Cl.[6] ..... F23J 3/00

[52] U.S. Cl. ..... 110/344; 110/341; 118/DIG. 5; 165/904

[58] Field of Search ..... 110/219, 234, 110/326, 341, 342, 344; 165/904; 126/677, 658; 118/308, DIG. 5

[56] References Cited

U.S. PATENT DOCUMENTS 4,255,213 3/1981 Redmond ..... 126/658 X
4,637,374 1/1987 Arai ..... 126/658 X
5,322,116 6/1994 Galloway et al. ..... 165/904 X

OTHER PUBLICATIONS

Hottel, Hoyt C. et al, "Radiant–Heat Transfer," Marks Handbook for Mechanical Engineers, 9th edition, Apr. 1966–Apr. 1967, 1987.

*Primary Examiner*—Henry A. Bennett
*Assistant Examiner*—Susanne G. Tinker
*Attorney, Agent, or Firm*—Madan & Morris, PLLC

[57] ABSTRACT

The present invention provides a method and composition for on-line treatment of furnace walls that are subject to deposition of highly reflective ash. The method involves exposing the walls to a darkening agent, or a combination of a darkening agent and a fluxing agent. The darkening agent, or the combined darkening agent and fluxing agent, may be mixed with the coal before it enters the boiler. Preferably, the appropriate walls of the boiler are treated directly with the darkening agent. A preferred embodiment involves direct application of the darkening agent to the water wall.

29 Claims, 1 Drawing Sheet

TREATMENT TO ENHANCE HEAT RETENTION IN COAL AND BIOMASS BURNING FURNACES

FIELD OF THE INVENTION

The present invention relates to methods and compositions for reversing the effect of tenacious, reflective, heat transfer-inhibiting ash deposits on boiler walls in coal and biomass burning furnaces. More particularly, the invention relates to a darkening agent for darkening highly reflective deposits of thin ash to enhance heat absorption through boiler surfaces that are covered by such ash.

BACKGROUND OF THE INVENTION

The Clean Air Act Amendments of 1990 require fossil-fuel-fired utilities to reduce $SO_2$ emissions by 10 million tons (−9 billion kilograms) from 1980 levels by the year 2000. Power companies are attempting a number of strategies to comply with these requirements. Predictions are that about one-half of the required $SO_2$ emission reductions will be achieved by switching existing plants to low-sulfur coal. Since coal furnaces are designed to burn a particular anticipated fuel source, the operational and economic impacts of such switching can be significant. Unfortunately, when the fuel source for a coal furnace is changed, other fuel properties also change. For example, when a furnace is switched to a coal with a lower sulfur content, the ash composition and/or the fouling and slagging characteristics of the coal also may change. These changes, in turn, can affect virtually all areas of the boiler system, including the furnace exit gas temperature. Control over furnace fireside temperatures can yield beneficial effects such as reduction of NOX emissions, reduction of slagging and fouling, and increased overall process efficiency.

The furnace exit gas temperature (FEGT) is the temperature of the gas as it leaves the combustion zone but before the gas enters the convection section of the furnace or boiler. The FEGT is an important control parameter in optimizing overall thermal efficiency and in maintaining the proper balance between heat absorption in the boiler furnace and in the convective sections. The fraction of heat recovered by a furnace is maximized when the temperature is maintained at or near that for which the furnace was designed. Maintaining the temperature within design parameters provides the optimum balance between steam production in the furnace, and steam reheating in the convective heat transfer section. The FEGT serves as a measure of the radiant heat removed in the furnace, and thus is a primary indicator of furnace performance.

Boiler tube cleanliness is important in order to achieve efficient heat transfer from hot combustion gases to the water side passages where steam is generated. Ash deposits on radiant furnace surfaces can alter heat absorption in the furnace in two ways. First, the deposits can thermally insulate the tube walls. Second, the deposits can change the effective reflectivity and emissivity of the tube wall surface.

Combustion of many low-sulfur coals commonly leads to the deposit of a tenacious, heat transfer-inhibiting ash on boiler walls. The ash deposit may be extremely thin, or up to several inches thick. Thin ash deposits often appear as a white or nearly white ceramic, while thicker deposits often are molten and glassy. In either case, the ash is extremely reflective. As a result, radiant heat that should be transferred in the boiler area leaves that section in flue gas at several hundred degrees above the temperature that the furnace was designed to accommodate. The increase in flue gas temperature leads to severe fouling (and loss of efficiency) for the convective heat transfer surfaces.

The reflective nature of the ash deposits significantly increases both the FEGT and the economizer exit gas temperature (EEGT), another commonly used control parameter. As a result, boiler operation can be severely limited by heat transfer problems. It is not uncommon to encounter EEGT increases of 22° C. (40° F.) or more where reflective ash deposits are present. Since an estimated 1% efficiency loss occurs with every increase in stack temperature of 22° C. (40° F.), the economic impact can be in the millions of dollars, even for modest size boilers. A much greater cost is associated with the forced derating of a power plant because it can no longer produce the quantity of steam at the temperatures needed to generate the electricity.

Attemperation is a common way to prevent steam temperatures from becoming unreasonably high due to poor heat absorption in a furnace. Attemperation involves spraying water to cool the steam. Unfortunately, attemperation capacity usually is limited. Excessive use of attemperation also can be detrimental to the boiler "heat rate"—an index of the efficiency of power generation expressed as the ratio of heat input (in the form of coal) to electrical power produced by the turbine generator.

Increased use of deposit removal equipment (known as "soot blowers") is a common reaction to reflective ash deposits; however, soot blowers are only partially effective in combating reflective ash. Increased blower use slows the ash accumulation rate but doesn't change the reflective properties of the ash. Any modest benefit is achieved at significantly higher maintenance costs (due to greater tube erosion and wear on the blower system) and higher energy requirements (for steam or compressed air to operate the soot blowers). Because soot blowers are only partially effective, boiler shutdowns are more frequently required to physically remove such deposits. Current cleaning procedures are time-consuming and expensive, and a furnace representing an investment of a billion dollars or more may be idle for a week. A more practical method for handling these ash deposits, which does not require shutting down the boiler system, would be highly desirable.

The Clean Air Act Amendments of 1990, and the need to dispose of huge quantities of agricultural waste (biomass), also have led to considerable interest in burning biomass as fuel in steam and/or power biolers. The burning of biomass, like the burning of Powder River Basin coals, also can yield reflective ash with its associated problems. This increased use of biomass as a fuel creates an additional need for a more practical method to handle these ash deposits.

SUMMARY OF THE INVENTION

The present invention provides a method and composition for on-line treatment of furnace walls that are subject to deposition of highly reflective ash. The method involves exposing the walls to a darkening agent, or a combination of a darkening agent and a fluxing agent. The darkening agent, or the combined darkening agent and fluxing agent, may be mixed with the coal before it enters the boiler. Preferably, the appropriate walls of the boiler are treated directly with the darkening agent. A preferred embodiment involves direct application of the darkening agent to the water wall.

DETAILED DESCRIPTION OF THE INVENTION

Figure 1:
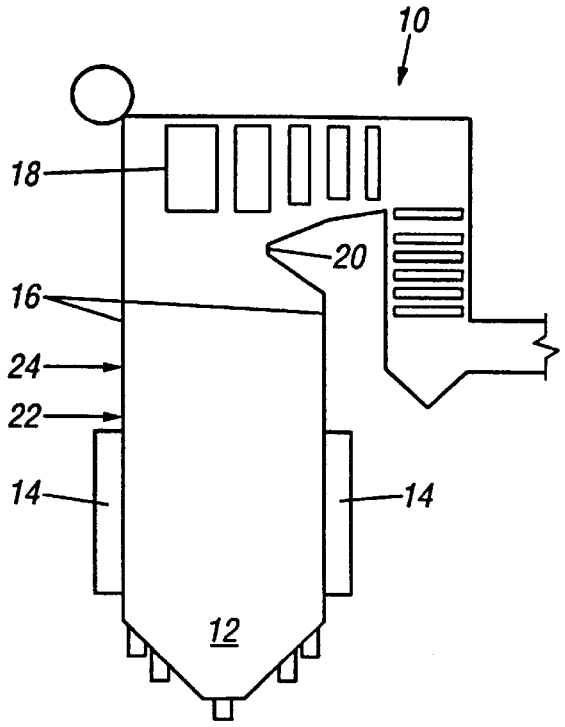
FIG. 1 is a side view schematic drawing of a boiler suitable for treatment according to the present invention.

FIG. 1 is a schematic depiction of a typical furnace to be treated according to the invention. The furnace 10 typically has a frustoconical base 12 for the escape of ash. Above the frustoconical base 12 are burners 14. Above the burners 14 is a middle section that includes a water wall 16. Above the water wall 16 is a "nose" 20, which directs the gas flow from the furnace. The steam tube sections 18 are located above the nose.

Reflective ash deposits tend to accumulate above the burners 14 along the water wall 16 and on the steam tube sections 18. In a preferred embodiment, the darkening agent is blown onto the surfaces of the water wall 16.

The darkening agent can be a metal, a metal oxide, a boride, a carbide, or a similar material which has a high enough melting point to survive the boiler temperature conditions and still darken the ash deposits. Alternately, the darkening agent may be a material that decomposes at furnace temperatures to yield a metal oxide, a boride, a carbide, or a similar material inside of the furnace. A preferred darkening agent is iron oxide. Other suitable darkening agents include bismuth trioxide, cadmium oxide, calcium boride, chromium oxide, cobalt oxide, copper oxide, manganese oxide, nickel oxide, silicon carbide, strontium boride, strontium carbide, tantalum carbide, tantalum oxide, tin oxide, titanium dioxide, tungsten carbide, vanadium carbide, vanadium oxide, and similar materials.

In some applications, the darkening agent, alone, may be all that is needed to bind to the reflective deposits and, thereby, enhance heat absorption. In other applications, a fluxing agent may be needed to promote sticking of the darkening agent to the relevant surfaces. The fluxing agent should not interfere with the operation of the invention in environments where it is not needed; therefore, a preferred embodiment uses a darkening agent mixed with a fluxing agent. Suitable fluxing agents are known in the art, and include, for example, the following:

| Fluxing Agents | |
|---|---|
| Borates | |
| Colemanite ore | $Ca_2B_6O_{11} \cdot 5\ H_2O$ |
| Ulexite ore | $NaCaB_5O_4 \cdot 8\ H_2O$ |
| Tincal | $Na_2B_4O_7 \cdot 10\ H_2O$ |
| Kernite | $Na_2B_4O_7 \cdot 4\ H_2O$ |
| Borax | $Na_2O \cdot 2\ B_2O_3 \cdot 10\ H_2O$ |
| Ammonium borate | $NH_4HB_4O_7 \cdot 3\ H_2O$ |
| Boric acid | $H_3BO_3$ |
| Sodium Tetraborate | $Na_2B_4O_7$ |
| Sodium Tetraborate | $Na_2B_4O_7 \cdot 10\ H_2O$ |
| Sodium perborate | $NaBO_3 \cdot H_2O$ |
| Non-borate | |
| Limestone | $CaCO_3$ |
| Dolomite | $MgCO_3 \cdot CaCO_3$ |
| Cryolite | $Na_3AlF_6$ |

Preferred fluxing agents are borate and naturally occurring boron-containing minerals.

The darkening agent or mix may be used in solid or liquid form and may be applied in any appropriate fashion. If a liquid is used, the liquid preferably should be an oil or water-based dispersion. The darkening agent or mix may be applied to the coal before the coal is placed in the furnace. Preferably, the darkening agent or mix is blown into the furnace near the part of the boiler wall that is coated with the reflective ash.

The invention will be more completely understood with reference to the following examples:

EXAMPLE 1

A 600 MW coal-fired boiler, originally designed to burn western coal, was switched to low-sulfur Powder River Basin coal. The following description refers to "levels" at a specific height above sea level. In this particular boiler, the burners were positioned between 970.8 m (3185 ft) and 979.9 m (3215 ft) above sea level, and the nose was at 1004 m (3294 ft) above sea level.

After the switch to Powder River Basin Coal, the water wall tubes (16, FIG. 1) developed a white, highly reflective ash coating that significantly reduced heat absorption in the water wall area. The reflective ash resulted in high superheat temperatures, high exit gas temperatures, high attemperation rates, and reduced efficiency.

A mixture of black iron oxide (75%) and sodium borate pentahydrate (25%) was formed into pellets (−4 to +14 mesh). At full load, the pellets were blown into the furnace through eductors inserted in inspection ports and directed at the water walls 16. A total of 204.5 kg (450 lbs) of material was injected into the furnace through ports at the sixth level 22 onto all four walls over a period of 6.5 hours. The sixth level was positioned just above the burners at 988.2 m (3242 ft). Monitoring the exit gas temperature before and after application showed a 25.5° C. (46° F.) reduction due to improved heat absorption. Visual observation confirmed the presence of a dark coating on part of the water walls.

A second application of the same material was made while the unit was operating at 385 MW. A total of 590.0 kg (1300 lbs) of product was fed through corner ports on level seven, located at 911.8 m (3254 ft), over a period of two hours. Again, a black coating was observed visually on the water walls. Temperature measurements in the platen area showed a significant decrease in gas temperature as a result of the treatment. The temperature of the platen area was reduced from 1285° C. (2345° F.) to 1193.3° C. (2180° F.) for a reduction of 91.7° C. (165° F.). A 10% reduction in secondary superheat spray, and a 3.5% reduction in reheat spray, also supported the reduction in exit gas temperature. These results were achieved with an estimated 26% coverage of the water wall surface by darkening agent.

EXAMPLE 2

In the following example, measurements were made on the division wall tubes (not shown in FIG. 1). The darkening agent normally is not applied to the division wall tubes; however, the division wall tubes have more inspection ports. The added inspection ports make the tubes more accessible to manual application of the darkening agent. The division wall tubes also are fitted with better instrumentation, making it possible to directly compare heat transfer with and without the darkening agent. Finally, the results achieved in the division wall tubes should correlate to the results that will be achieved when the darkening agent is applied to the water wall and/or the steam tube sections. The following procedure permitted quantitative on-line measurement of the gain in heat transfer and the duration of that gain using existing steam flow and temperature data.

A pelletized iron oxide/sodium borate blend (75/25) was air educted into a 690 MW boiler operating at 600 MW and burning Powder River Basin coal. The eduction was focused on approximately 8.2 m (27 feet) of the inner surface of the division wall or wing wall, which runs substantially parallel to the water wall.

The following program was run:

| Hours | Procedure | Additive |
|---|---|---|
| 0–87.5 | Baseline testing | None |
| 87.5–89.0 | Ash modifier application | 1363.3 kg (3000 lbs) |
| 89.0–104.5 | Monitoring | None |
| 104.5–105.5 | Ash modifier application | 1363.3 kg (3000 lbs) |
| 105.5–210 | Monitoring | None |

Figure 2:
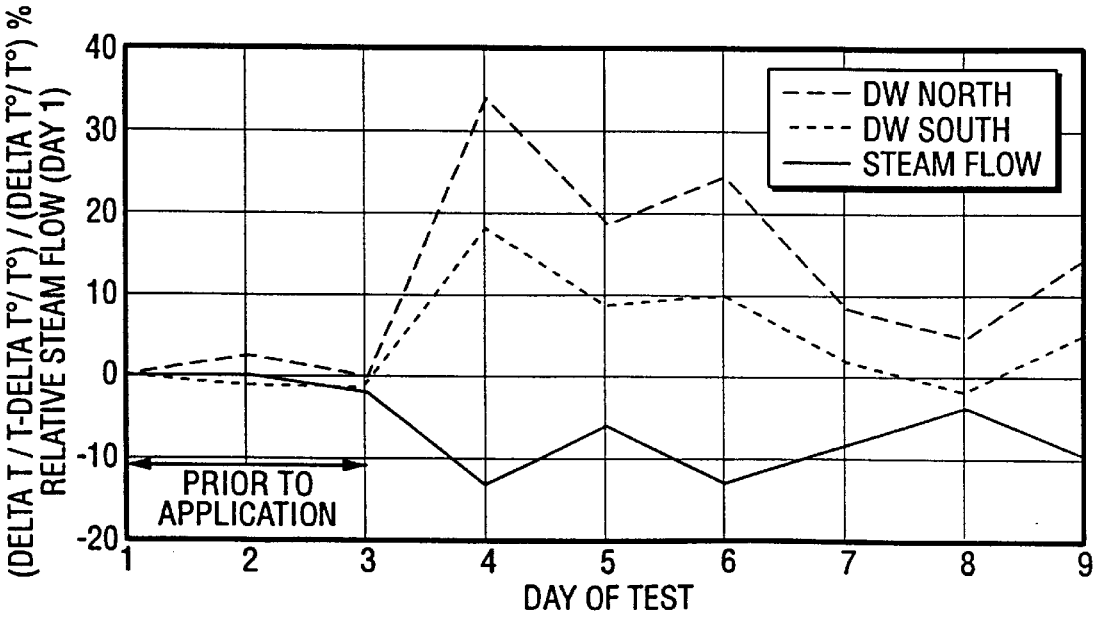
FIG. 2 is a graph of the results from Example 2.

By determining the heat takeup of the superheater during service, it is possible to quantify the effect of the ash modifier (darkening agent). The results are shown in FIG. 2. The heat pickup is defined as AT/T to cancel out the effect of changes in other temperatures and operating conditions. $(\Delta T/T-\Delta T°/T°)/(\Delta T°/T°)$ is the numerical difference between the outlet and inlet steam temperatures for the division wall superheater divided by the inlet temperature, expressed as a percentage. The increase in heat transfer in the division wall superheater header corresponded directly to the application of the ash modifier.

In the first day after the application, heat pickup in the south header increased up to 32%, and heat pickup in the north header increased up to 18%. The increase in heat pickup decayed slowly back to baseline conditions over a 5-day period.

Persons of skill in the art will appreciate that many modifications may be made to the embodiments described herein without departing from the spirit of the present invention. Accordingly, the embodiments described herein are illustrative only and are not intended to limit the scope of the present invention.

We claim:

1. A method for improving the heat absorption of a furnace wall that is at least partially coated with reflective ash comprising applying to at least a portion of said reflective ash a combination of a darkening agent and an amount of a fluxing agent that is sufficient to bind said darkening agent to said reflective ash.

2. The method of claim 1 wherein said exposed portion of said furnace wall comprises a water wall.

3. The method of claim 2 wherein said darkening agent is selected from the group consisting of a metal, a metal oxide, a boride, and a carbide.

4. The method of claim 3, wherein said fluxing agent is selected from the group consisting of borate and the class consisting of borates and naturally occurring boron-containing minerals.

5. The method of claim 3, wherein said fluxing agent is selected from the group consisting of borate and the class consisting of borates and naturally occurring boron-containing minerals.

6. The method of claim 3, wherein said fluxing agent comprises boron.

7. The method of claim 2 wherein said darkening agent is iron oxide.

8. The method of claim 2, wherein said fluxing agent is selected from the group consisting of borate and the class consisting of borates and naturally occurring boron-containing minerals.

9. The method of claim 2, wherein said fluxing agent comprises boron.

10. The method of claim 2, wherein said fluxing agent is selected from the group consisting of borate and the class consisting of borates and naturally occurring boron-containing minerals.

11. The method of claim 1 wherein said darkening agent is selected from the group consisting of a metal, a metal oxide, a boride, and a carbide.

12. The method of claim 11 wherein said darkening agent is iron oxide.

13. The method of claim 1 wherein said darkening agent is iron oxide.

14. The method of claim 3 wherein said darkening agent is iron oxide.

15. The method of claim 1, wherein said fluxing agent is selected from the group consisting of borate and the class consisting of borates and naturally occurring boron-containing minerals.

16. A method for improving the heat absorption of a furnace wall that is at least partially coated with reflective ash comprising blowing directly onto at least a portion of said reflective ash a combination of a darkening agent and an amount of a fluxing agent that is sufficient to bind said darkening agent to said reflective ash.

17. The method of claim 16 wherein said exposed portion of said furnace wall comprises a water wall.

18. The method of claim 16 wherein said darkening agent is selected from the group consisting of a metal, a metal oxide, a boride, and a carbide.

19. The method of claim 17 wherein said darkening agent is selected from the group consisting of a metal, a metal oxide, a boride, and a carbide.

20. The method of claim 16 wherein said darkening agent is iron oxide.

21. The method of claim 17 wherein said darkening agent is iron oxide.

22. The method of claim 16 wherein said fluxing agent is selected from the group consisting of borate and the class consisting of borates and naturally occurring boron-containing minerals.

23. The method of claim 17 wherein said fluxing agent is selected from the group consisting of borate and the class consisting of borates and naturally occurring boron-containing minerals.

24. The method of claim 16 wherein said fluxing agent comprises boron.

25. The method of claim 17 wherein said fluxing agent comprises boron.

26. The method of claim 18 wherein said fluxing agent comprises boron.

27. The method of claim 19 wherein said fluxing agent comprises boron.

28. The method of claim 20 wherein said fluxing agent comprises boron.

29. The method of claim 21 wherein said fluxing agent comprises boron.

* * * * *